United States Patent [19]

Epis

[11] 3,987,454

[45] Oct. 19, 1976

[54] LOG-PERIODIC LONGITUDINAL SLOT ANTENNA ARRAY EXCITED BY A WAVEGUIDE WITH A CONDUCTIVE RIDGE

[75] Inventor: James J. Epis, Sunnyvale, Calif.

[73] Assignee: GTE Sylvania Inc., Mountain View, Calif.

[22] Filed: June 23, 1975

[21] Appl. No.: 589,475

[52] U.S. Cl. ..... 343/771; 343/792.5; 333/95 R; 333/98 R

[51] Int. Cl.[2] ..... H01Q 13/10

[58] Field of Search ..... 343/771, 770, 792.5, 343/705, 708

[56] References Cited

UNITED STATES PATENTS

| | | | |
|---|---|---|---|
| 2,648,839 | 8/1953 | Ford et al. | 343/771 |
| 2,929,065 | 3/1960 | Kreinheder | 343/770 |
| 3,346,865 | 10/1967 | Jones, Jr. | 343/708 |
| 3,530,478 | 9/1970 | Cozine | 343/792.5 |
| 3,555,232 | 1/1971 | Bleackley | 343/771 |
| 3,604,010 | 9/1971 | Schwartz | 343/771 |
| 3,633,207 | 1/1972 | Ingerson | 343/770 |

FOREIGN PATENTS OR APPLICATIONS

| | | | |
|---|---|---|---|
| 613,314 | 1/1961 | Canada | 343/771 |

*Primary Examiner*—Alfred E. Smith
*Assistant Examiner*—David K. Moore
*Attorney, Agent, or Firm*—Lockwood, Dewey, Zickert & Alex

[57] ABSTRACT

A log-periodic longitudinal slot antenna array comprises a dimensionally linearly tapered ridged waveguide having a wall forming part of a metallic ground plane and in which longitudinally elongated and spaced slots are formed. The long axis of each slot is perpendicular to the transverse component of the magnetic field in the waveguide and the slots have dimensions and inner-slot spacings which decrease in increments of a predetermined ratio $\tau$ in a direction toward the smaller end of the tapered waveguide. The antenna produces a fan-shaped beam with its narrowest radiation pattern lying in a plane perpendicular to a line parallel to the transverse magnetic field component in the waveguide. Such fan-shaped beams are obtainable when the antenna structure is fed at either the large or small ends of the waveguide, or at both ends, in which cases the boresight axes of the resultant beams extend in different directions. The distinguishing physical feature of unidirectional versions of the antenna relative to unidirectional versions in the antenna array family described in the herein identified cross-reference application is that all of the slot radiators are displaced to one side or to the other of the electric (E) plane of the waveguide but never to both of these sides. As such, the corresponding distinguishing electrical feature is that all sub-components of the time-phases of the electric field excitations in all slots due solely to the transverse locations of the slots are intrinsically identical.

For bi-directional radiation patterns, a similar array of slots is formed in the opposite wall of the waveguide which optionally may comprise an extended ground plane.

14 Claims, 18 Drawing Figures

LOG-PERIODIC LONGITUDINAL SLOT ANTENNA ARRAY EXCITED BY A WAVEGUIDE WITH A CONDUCTIVE RIDGE

CROSS-REFERENCE TO RELATED APPLICATION

Ser. No. 589,476 filed June 23, 1975 for Log-Periodic Longitudinal Slot Antenna Array.

BACKGROUND OF THE INVENTION

This invention relates to slot antennas and more particularly to broadband log-periodic slot antenna arrays.

The use of the log-periodic dipole antenna array for psuedo frequency-independent operation is well known. There are many applications, however, which require a flush-mounted antenna such as one designed for the surface of an aircraft and for these uses the dipole antenna array is not suitable. The slot antenna array is particularly well adapted to such flush-mounted applications since the radiating elements are slots themselves formed in the ground plane.

Log-periodic cavity-backed transverse slot antenna arrays have been proposed in the past in an effort to duplicate the operating characteristics of the dipole counterpart but have met with only limited success. For example, such an antenna is described in an article entitled "A Log Periodic Cavity-Backed Slot Antenna" by V. A. Mikenas and P. E. Mayes, 1966 IEEE — PGAP Symposium Digest, Palo, Alto, Calif.

OBJECTS AND SUMMARY OF THE INVENTION

A general object of this invention is the provision of relatively high gain, broadband log-periodic slot antenna arrays with any version having a radiation pattern which is boresighted in directions different from those corresponding to "end-fire" and "back-fire", with the special case of near-broadside-fire possibly being the most important achievable objective.

Another object is the provision of log-periodic antennas capable of producing fan-shaped beams without arraying two or more antennas.

A further object is the provision of log-periodic antennas whose gain, beamwidth and beam-boresight directions are variable appreciably through change of one or more of the available design parameters without arraying two or more antennas.

Still another object is the provision of dual-mode log-periodic antenna structures with any version capable of supplying two independent antenna patterns boresighted in different directions when fed from either one of the two input terminals and wherein these antenna beams can be used either simultaneously or one at a time.

These and other objects of the invention are achievable with a log-periodically related array of longitudinal slots backed by a tapered ridged waveguide such that, for unidirectional radiation, the slots are formed in one of the waveguide walls on the same side of the E-plane of the waveguide (i.e., the plane containing the strongest electric field line in the waveguide). This antenna may be fed from either or both ends of the waveguide and produces beams boresighted at different angles from broadside (normal to the ground plane) depending upon which end of the waveguide constitutes the antenna feed point. Bi-directional beams are produced with a similar waveguide structure having a log-periodic array of slots formed in each of two walls of the tapered ridged waveguide on opposite sides of the E-plane of the waveguide.

DESCRIPTION OF PREFERRED EMBODIMENTS

One physical distinction between unidirectional versions of antennas embodying this invention and those of the invention described in the cross-referenced application Ser. No. 589,476 is that in the latter invention any pair of consecutive slot radiators are situated on alternate or opposite sides of the E-plane of the tapered waveguide, whereas all slot radiators are on the same side of that plane in the unidirectional antennas embodying this invention. A second physical distinction is that all slots in the unidirectional antennas of the cross-referenced invention are on either a top wall or else a bottom wall of the waveguide, but never in both of those walls in one and the same antenna version, whereas the slots in any unidirectional antenna of this invention are all on a top wall, or all on a bottom wall, or all in one of the two side walls, where the electric field in the waveguide is perpendicular to the top and bottom walls and is vanishingly small at both side walls. The electrical distinction due to these physical distinctions is profound because the partial time phase difference of the electric field excitations in any consecutive pair of slots, which partial phase difference is the component of total phase difference due solely to the transverse location of those slots, is 180° in antennas embodying the cross-referenced invention but zero degrees in antennas of this invention. The practicably important net result of this difference is that, for operation over the same frequency band, a given antenna of the cross-referenced invention is physically about onehalf as long as the corresponding antenna in this invention, so that the power gain of the fan-shaped beam provided by the latter antenna is about twice as high as (or three db more than) that of the corresponding antenna of the former invention. Antenna versions in the cross-referenced invention are therefore more suitable for those applications in which space is limited and/or it is desirable to employ fan-shaped beams whose narrow radiation pattern beamwidths are about twice those of corresponding antennas in the present invention. Conversely, antenna versions of the present invention will be preferred when their additional physical length is not critically important and/or their additional 3 db of antenna gain is either desired or required in any pertinent system application.

Figure 1:
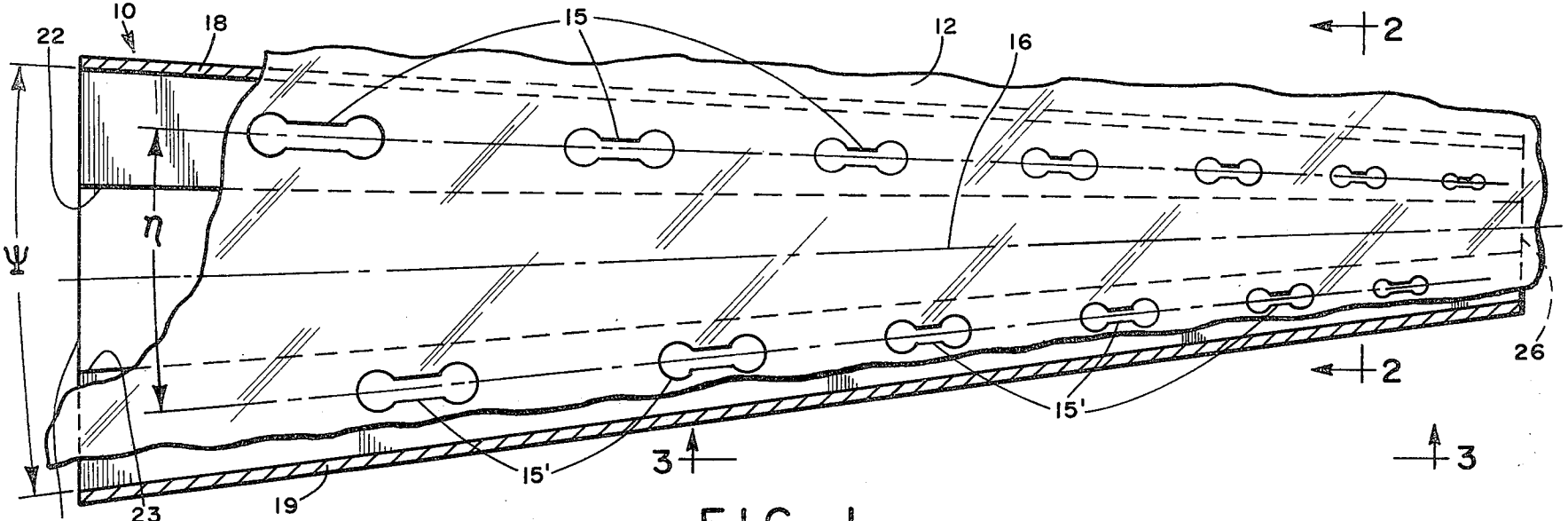
FIG. 1 is a plan view of the ground plane side of the antenna as viewed on line 1—1 of FIG. 2.
Figure 3:
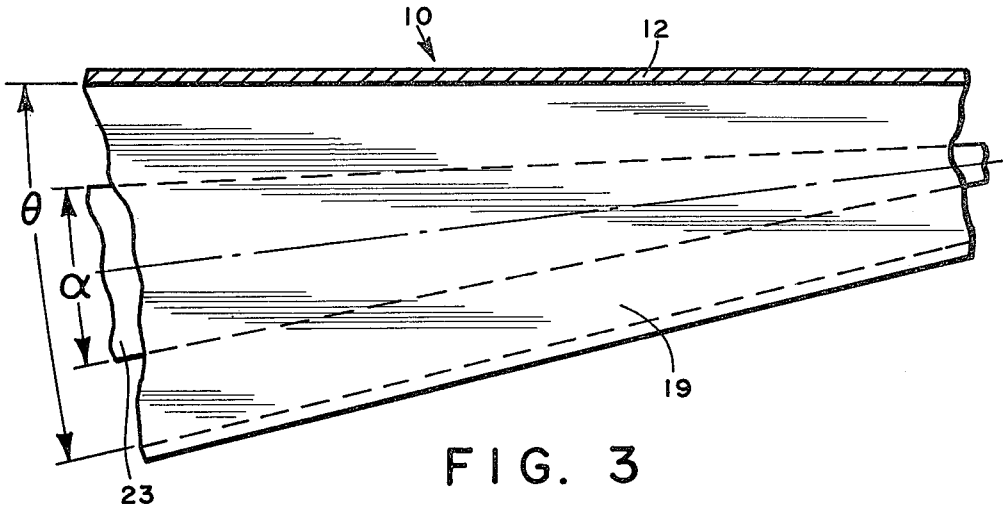
FIG. 3 is a longitudinal view of the antenna taken on line 3—3 of FIG. 1.
Figure 2:
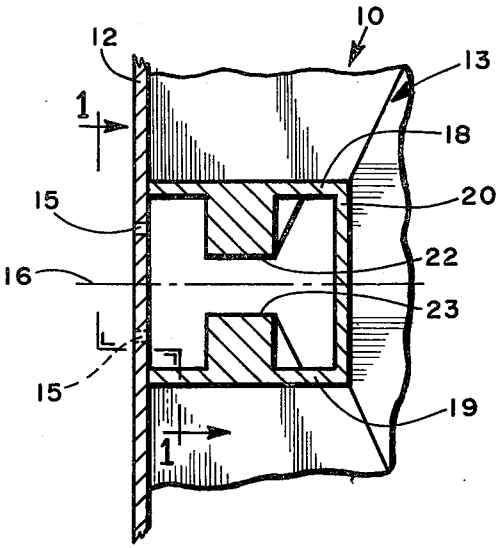
FIG. 2 is a transverse section of the antenna taken on line 2—2 of FIG. 1.

Referring now to the drawings, an antenna 10 embodying this invention is shown in FIGS. 1, 2 and 3 and comprises a ground plane 12 forming part of one of the side walls of a linearly tapered doubly-ridged waveguide 13. In this version, the ground plane has a plurality of slots 15 and 15' formed on opposite sides of the magnetic field center plane 16 of the waveguide with inter-slot spacing and slot dimensions decreasing in increments of a predetermined ratio $\tau$ in accordance with log-periodic antenna design. In other words, the dimensions and inter-slot spacings are log-periodically related in accordance with the following relationship:

$$d_m = d_{m-1}/\tau$$

where $d_m$ is any dimension of the mth slot, $d_{m-1}$ is the corresponding dimension of the next smaller slot, and $\tau$ is a numerical constant.

Waveguide 13 has top and bottom walls 18 and 19, respectively, and a side wall 20 opposite the ground plane 12 which comprises the other side wall of the waveguide. Ridges 22 and 23 project inwardly from top wall 18 and bottom wall 19, respectively, of the waveguide. The cross-sectional dimensions of the waveguide taper from a maximum dimension at one end 25 to minimum at the opposite end 26 with the top and bottom walls converging at an angle $\Psi$, the side walls at an angle $\theta$ and the widths of the ridges at an angle $\alpha$.

Slots 15 and 15' are longitudinally elongated dumbbell-shaped apertures with substantially parallel axes and arranged in two rows on opposite sides of center H-plane 16 with longitudinally successive slots on each of those sides. The rows of slots converge at an angle $\eta$ and each row is optimally spaced between the center plane 16 and top or bottom waveguide wall for maximum coupling of energy from the waveguide to free space. While dumbbell-shaped slots are illustrated in this embodiment of the invention, ridged slots and even simple rectangular slots are also usable. An antenna may be formed with both rows of slots 15 and 15' as shown or with either one row of slots 15 or 15' but not both. An antenna with slots 15 and 15' in cmparison to one having either slots is or 15' will have a narrower beamwidth for the broad radiation pattern of the fan-shaped beam and hence a higher antenna gain. Other antenna versions with slots on a side wall of the waveguide have any number of rows of slots.

Figure 4:
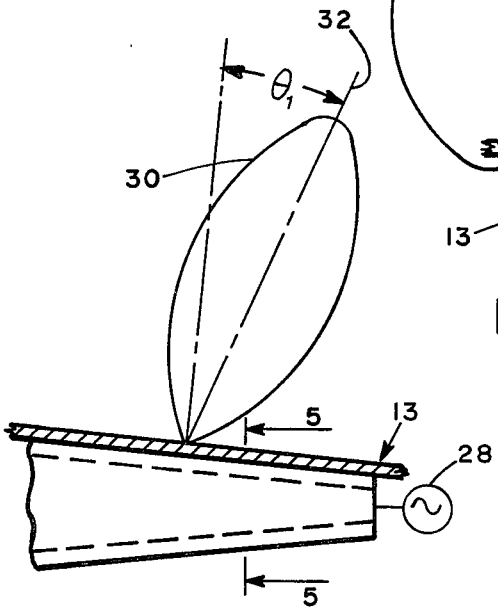
FIG. 4 is a partly schematic view of the antenna similar to FIG. 3 showing a typical H-plane radiation pattern when the tapered waveguide is fed at the smaller or right end as viewed.
Figure 6:
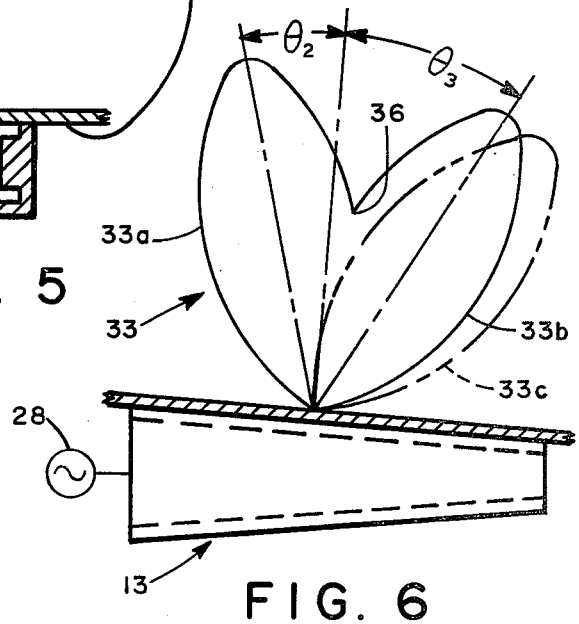
FIG. 6 is a view similar to FIG. 4 in which the antenna is fed at the larger or left end as viewed of the waveguide.

An important an unique feature of this invention is that the antenna is energized by feeding the waveguide 13 either at its smaller end as shown in FIG. 4, or at its larger end as shown in FIG. 6, or at both ends simultaneously. The source of electromagnetic wave energy is indicated schematically at 28 and preferably consists of an oscillator or pulse generator or the like suitably coupled to the waveguide. It should be understood that the source 28 may also comprise a receiver or the like when the antenna is used in the receiving rather than the transmitting mode.

Figure 5:
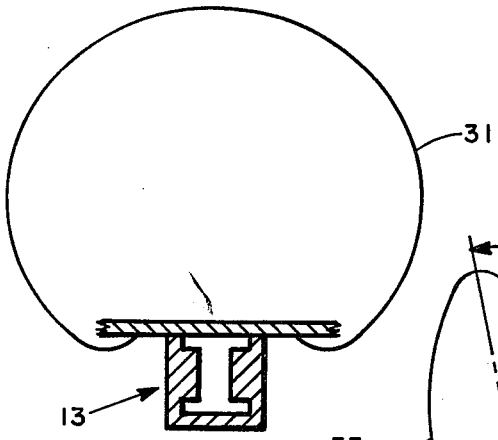
FIG. 5 is a section taken on line 5—5 of FIG. 4 and showing the radiation pattern in the E-plane.

In accordance with this invention, the radiation pattern 30 in the H-plane as shown in FIG. 4 is relatively narrow with a half-power beamwidth of approximately 13° whereas the radiation pattern 31 in the E-plane, see FIG. 5, is broad and approaches a semicircle as the width of the ground plane is increased indefinitely and there is only one row of slots such as only the slots 15 in FIG. 1. Thus the radiation beam derived from this antenna is fan-shaped and is ideally suited for applications such as electronic counter-measures of a target antenna at an unknown location in one of two orthogonal planes or direction finding of a target antenna at an unknown angular direction in one of two orthogonal planes, without being required to move or scan the antenna mechanically in either example. In such applications, fan-shaped beams are highly desirable if not required. The radiation boresight or beam axis 32 is at an angle $\theta_1$ from broadside of between 5° and 45° when the waveguide is fed at its smaller end. The operating bandwidth of certain versions of these antennas when fed at their smaller ends, however, is larger than when fed at their larger ends because deleterious effects due to the excitation of higher order modes of propagation is thereby accommodated while sufficient coupling of energy to free space is achieved. In such special cases, or as the bandwidth is extended to bandwidths approaching or exceeding 2 octaves, the slot radiators in the unidirectional antennas preferably are also located at strategic or special locations on the top wall or else the bottom wall only.

Another important and unique feature of this invention is the capability of the antenna to provide different radiation patterns when the waveguide is fed at its larger end. As illustrated in FIG. 6 in one version this pattern consists of a split beam 33 having two beam parts 33*a* and 33*b* with boresight axes 34 and 35, respectively, angularly related to each other such that the beam parts overlap and intersect at 36 to provide a null point. Beam axes 34 and 35 extend at angles $\phi_2$ and $\phi_3$, respectively, with broadside. This dual beam pattern is particularly useful in direction finding applications and thus provides the single antenna with an enhanced capability simply by selection of the feed point of the waveguide. By decreasing the inter-slot spacings relative to those in the antenna described above, a single high gain fan-shaped beam 33*c*, shown in broken lines in FIG. 6, is achievable with the structure excited at the large end, as well as a second fan-shaped beam when the structure is fed at the small end, with these two beams being boresighted in different directions.

Figure 7:
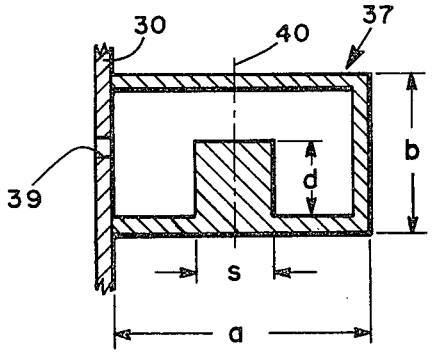
FIG. 7–11, inclusive, show alternate forms of ridged waveguide feed structures for antennas embodying this invention.
Figure 8:
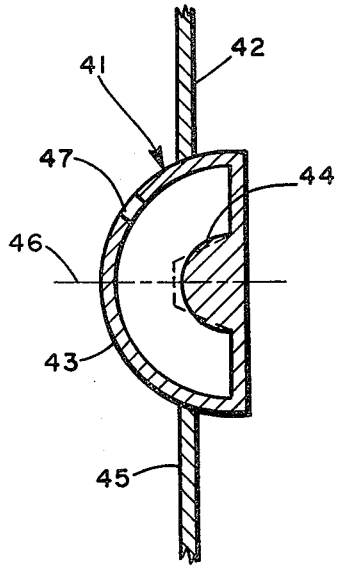

In addition to the doubly-ridged waveguide 13 of FIGS. 1–3, the invention may be practiced as well with other tapered waveguide configurations adapted for broadband propagation of electromagnetic waves. FIG. 7 shows a singly-ridged rectangular waveguide 37 connected to ground plane 38 in which longitudinally spaced slots 39 are formed generally as described above on the ground plane side of the waveguide E-plane 40. FIG. 8 shows an antenna comprising a semicircularly shaped waveguide 41 having a plane wall 42, a semicircular wall 43, a ridge 44 on wall 42 formed concentrically of wall 43 and a ground plane 45 intersecting wall 43 and extending parallel to wall 42. The waveguide E-plane 46 bisects the waveguide as shown and slots 47 are formed in wall 43 on the same side of the E-plane. Alternatively, ridge 44 may have a trapezoidal cross section as indicated in broken lines in the figure.

Figure 9:
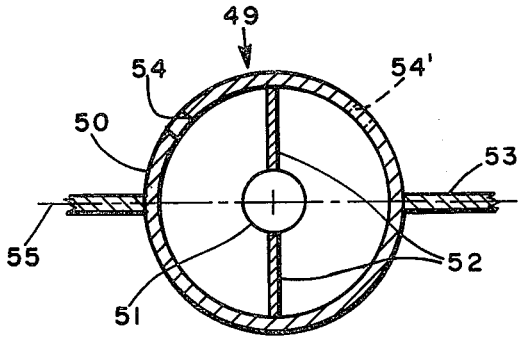

Another modified form of the invention is shown in FIG. 9 wherein waveguide 49 has a cylindrical outer wall 50, a cylindrical coaxial center ridge member 51 with a metallic septum 52 interconnecting member 51 and wall 50 so as to divide the interior of the waveguide. Ground plane 53 intersects the outer wall and slots 54 and/or 54' are formed in wall 50 with all slots being on the same side of E-plane 55 as shown. Both halves of waveguide 49 are excited with the $TE_{11}$ modes of equal magnitude and in time phase preferably using a suitable feed circuit such as a hybrid junction.

Figure 10:
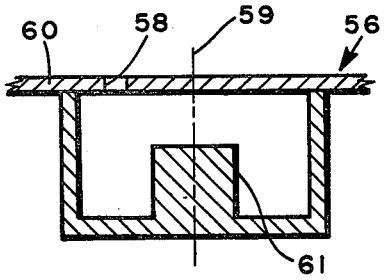
Figure 11:
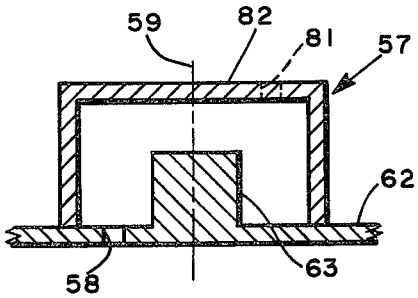

Still further modified forms of the invention are shown in singly-ridged rectangular waveguides 56 and 57 shown in FIGS. 10 and 11, respectively. In waveguide 56, longitudinally spaced slots 58 are formed on one side of E-plane 59 and in ground plane 60 which forms part of the waveguide wall opposite ridge 61 whereas waveguide 57 differs from waveguide 56 only in that the ground plane 62 is part of the waveguide wall from which the ridge 63 projects, like parts being indicated by like reference characters. While singly-ridged waveguides are illustrated in FIGS. 10 and 11, it will be understood that doubly-ridged waveguides may be substituted for waveguides 56 and 57 without departing from the precepts of the invention and still achieving substantially the same operating results.

Figure 12:
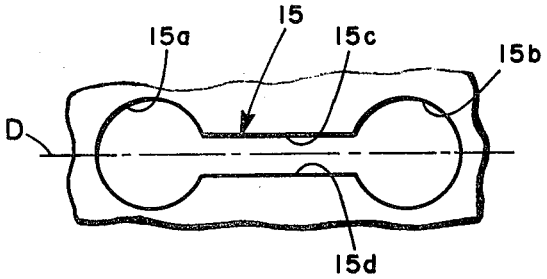
FIG. 12 is an enlarged view of part of a waveguide wall showing details of a particular slot configuration.

An enlarged view of a dumbbell-shaped slot 15 is shown in FIG. 12 and is defined by circular end edges 15*a* and 15*b* and spaced straight edges 15*c* and 15*d* parallel to the longitudinal slot axis D and intersecting the circular edges. The dimensions of this slot are selected to optimize the impedances presented by the log-periodic array of slots to achieve maximum energy transfer from the waveguide to free space. The practice of the invention, however, is not limited to this particular slot configuration as mentioned above.

Figure 13:
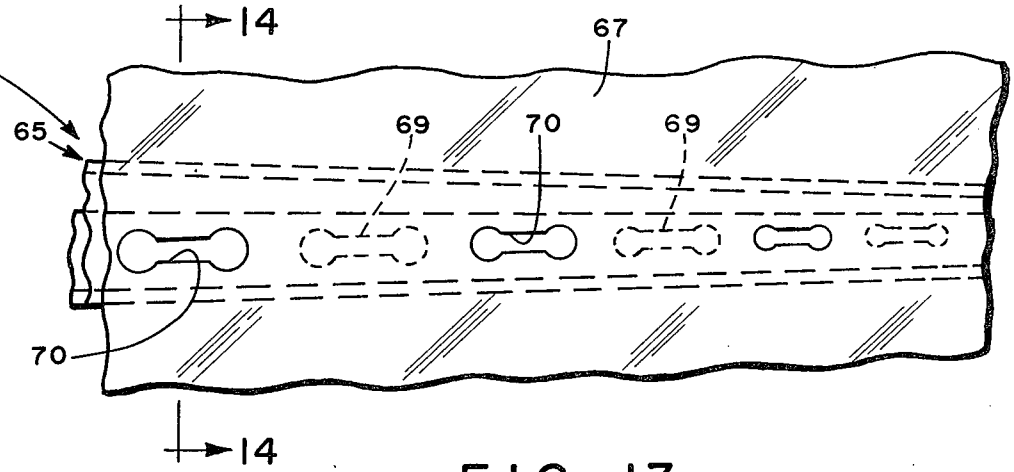
FIG. 13 is a plan view of one of the two ground planes constituting part of an antenna embodying the invention capable of bi-directional radiation.
Figure 14:
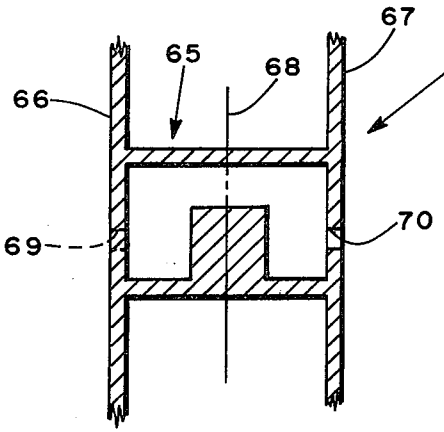
FIG. 14 is a section taken on line 14—14 of FIG. 13.

The invention may also be practiced to provide bi-directional fan-shaped beams instead of the unidirectional beam obtained with the antennas of FIGS. 1–3, inclusive, and FIGS. 7–11, inclusive. Such a bi-directional beam antenna is shown at 64 in FIGS. 13 and 14 and comprises a linearly tapered singly-ridged waveguide 65 with side walls constituting parts of ground planes 66 and 67, respectively, on opposite sides of the E-plane 68 of the waveguide. Slots 69 and 70 are formed in the waveguide side wall portions of ground planes 66 and 67, respectively, so as to couple energy from the waveguide into free space simultaneously and in opposite directions. As shown in FIG. 13, longitudinally successive slots are in opposite side walls of the waveguide. The dimensions and longitudinal spacings for such adjacent slots decrease from the large end of the waveguide to the smaller end in increments of a predetermined ratio as described above. In other respects antenna 64 operates essentially as antenna 10 described above.

Figure 15:
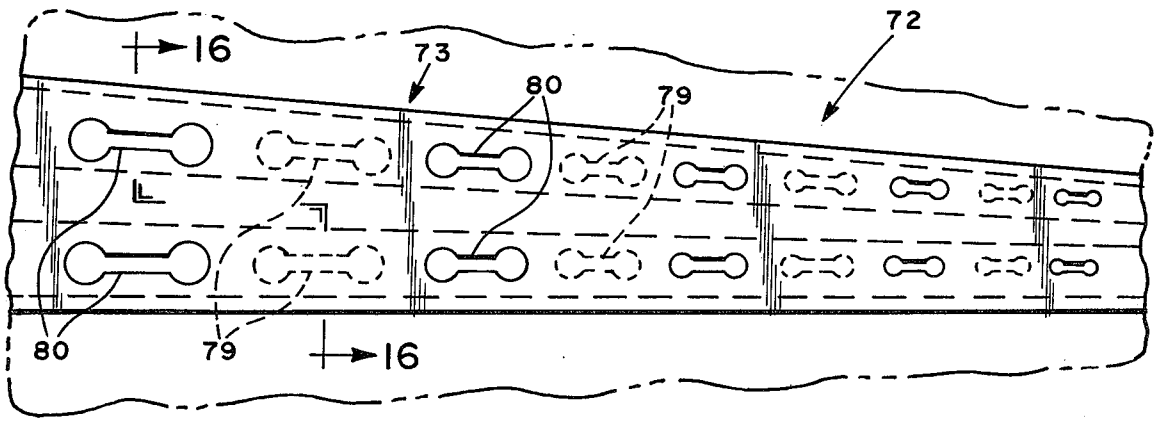
FIG. 15 is a view similar to FIG. 13 showing a modified form of bi-directional antenna.
Figure 16:
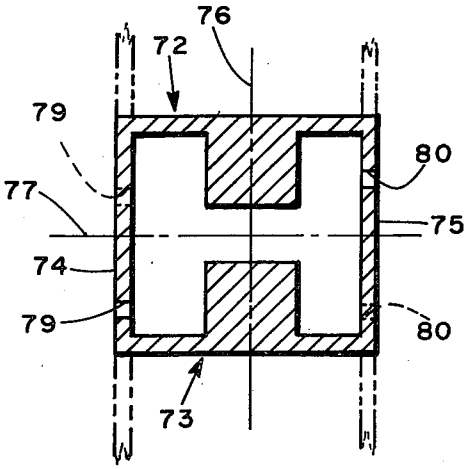
FIG. 16 is a section taken on line 16—16 of FIG. 15.

Another form of this invention is the antenna 72, see FIGS. 15 and 16, for supplying a bi-directional fan-shaped beam with the capability for additional control for further reducing the beamwidth of the two broadest radiation patterns on the bi-directional fan-shaped beam. Antenna 72 comprises doubly-ridged waveguide 73 having side walls 74 and 75 which optionally may constitute part of extended ground planes shown in broken lines. The waveguide 73 has a central E-plane 76 and a central H-plane 77. Instead of a single slot in either side wall at one longitudinal position along the axis of the waveguide as in FIG. 13, this antenna has a pair of slots. Thus side wall 74 has slots 79 symmetrically disposed about the H-plane at one longitudinal position and at the adjacent longitudinally spaced position side wall 75 has slots 80 similarly symmetrically formed about the H-plane. The net effect of this distribution of slots is to provide a bi-directional fan-shaped beam with narrower beamwidths and higher gain. In other respects antenna 72 operates essentially as antenna 64 described above. Other antennas otherwise similar to antenna 72 have any number of rows of slots on each of their two side walls, including just one row on each side wall.

Bi-directional antenna versions of this invention are also obtainable with the slots on the top and bottom walls of the waveguide as illustrated by the additional row of slots 81 in top wall 82 of waveguide 57 in FIG. 11. In this embodiment the two rows of slots 58 and 81 are on opposite sides of the E-plane. Still another version is a similar slot arrangement but with the waveguide being doubly-ridged. These are two of only a few antenna versions of this invention in which longitudinally successive slots are on opposite sides of the waveguide E-plane. Such slots are excited with zero phase difference due to their transverse location because they are also located on the top and bottom walls of the waveguide.

Figure 17:
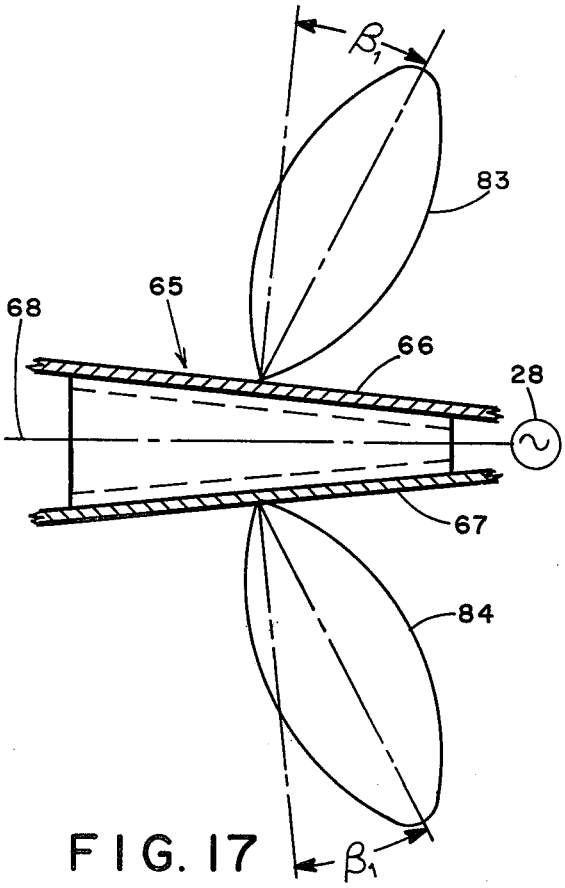
FIG. 17 is a schematic section similar to FIG. 4 showing a bi-directionally radiating antenna fed at the small end of the feed waveguide.
Figure 18:
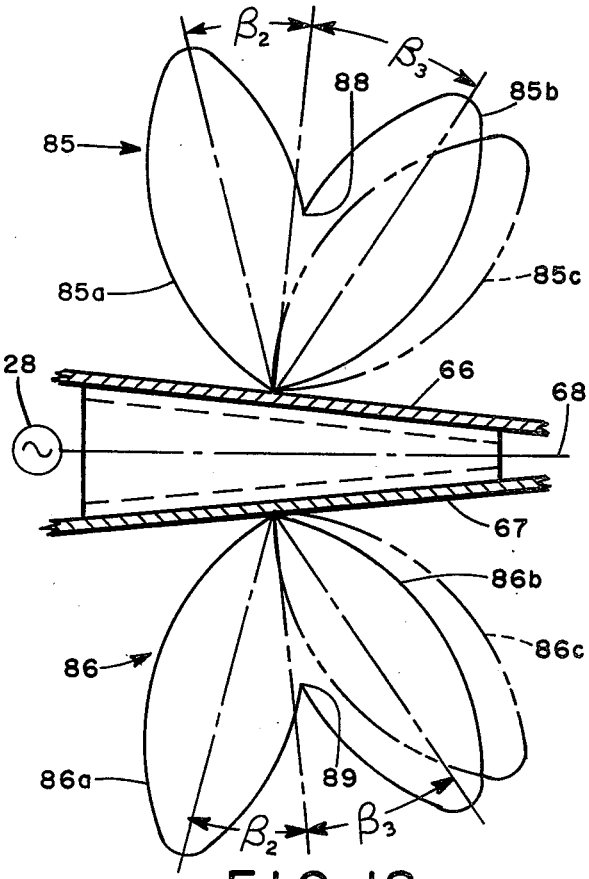
FIG. 18 is a view similar to FIG. 6 showing a bi-directionally radiating antenna fed at the large end of the waveguide.

The effect of feeding waveguide 65 (or 73) at its smaller end from source 28 is illustrated in FIG. 17 in which the bi-directional beams 83 and 84 (H-plane patterns) are boresighted at angles $\beta_1$ from broadside toward the smaller end of the waveguide. When fed at the larger end of the waveguide, as shown in FIG. 18 in one version, oppositely directed, split beams 85 and 86 (similar to split beam 33 in FIG. 6) radiate from opposite sides as shown . The axes of parts 85*a* and 85*b* of beam 85 are at angles $\beta_2$ and $\beta_3$, respectively, from broadside as are the corresponding axes of beam 86. Beams 85 and 86 have null points 88 and 89, respectively. By using smaller inter-slot spacings, each of these split beams can be made to merge into a single beam 85*c* or 86*c* as indicated in broken lines.

An antenna of the type shown in FIG. 7 was constructed and successfully operated with satisfactory results. The design parameters of this antenna are as follows:

| | |
|---|---|
| Axial length of waveguide | 28.591 |
| Waveguide cross section: | |
| Singly-ridged, rectangular | |
| Slots centered on waveguide wall | |
| Log periodic ratio $\tau$ | 0.9636 |
| Type of slot | Dumbbell-shaped |
| Total number of slots | 10 |
| Spacing between two largest slots | 2.4727 inches |
| Electrical design parameter: | |
| K = any slot resonant frequency divided by local cut-off frequency in the tapered waveguide | 2.47 |
| Boresight (beam axis) relative to broad-side (normal to ground plane) | |
| Small end feed: | 6 degrees |
| Large end feed: | |
| $\phi_2$ | 27 degrees |
| $\phi_3$ | 50 degrees |
| Operating bandwidth | 1.3:1 |
| Operating frequency range | 4.1 GHz to 5.4 GHz |
| Input VSWR over operating band | |

-continued

| | |
|---|---|
| Small end feed: | Less than 1.4:1 |
| Large end feed: | Less than 1.4:1 |
| Half-power Beamwidths | |
| Small end feed: | |
| H-plane: | 13 degrees |
| E-plane: | 138 degrees |

The bandwidths of the foregoing antenna models for each feed case are definitely capable of being extended to at least 2.25:1 by making each antenna and tapered waveguide considerably longer and adding considerably more slots in a log-periodic fashion.

What is claimed is:

1. A broadband antenna comprising a closed electrically conductive TE-mode ridged waveguide linearly longitudinally tapered between a first end having a maximum cross-sectional dimension and a second end having a minimum cross-sectional dimension, said waveguide having a first wall from which a conductive ridge projects and having a second wall, said waveguide being adapted to longitudinally propagate TE-mode electromagnetic waves having an electric (E) vector field normal to said first wall and a magnetic (H) component vector field normal to said E-field vector, said waveguide having orthogonal central E and H planes parallel to said E-field and said H-field vectors, respectively, at least one of said walls having a plurality of longitudinally spaced slots formed with both the spacing between longitudinally adjacent slots and slot dimensions decreasing in increments of a predetermined ratio from said first end of the waveguide to the second end, said slots in said one wall being located on the same side of said waveguide E plane, each of said slots being longitudinally elongated substantially in the direction of wave propagation, and energy feed means connected to at least one of said ends of said waveguide whereby the energy radiation pattern is a beam boresighted transversely of the slotted wall.

2. The antenna according to claim 1 in which said one of said walls is perpendicular to said first wall and said slots are formed in said one wall along at least one line.

3. The antenna according to claim 2 with said slots being formed along two lines converging in a direction toward said second waveguide end, said waveguide H plane being centrally located between said lines.

4. The antenna according to claim 1 in which said one of said walls is opposite said first wall, said slots being formed along at least one line in a longitudinal direction.

5. The antenna according to claim 1 in which said one of said walls is said first wall with said slots being formed along at least one line in a longitudinal direction.

6. The antenna according to claim 1 in which said one of said walls comprises a portion of a ground plane member extending beyond said waveguide.

7. The antenna according to claim 1 with independent energy feed means connected to both ends of said waveguide whereby the energy radiation constitutes two independent beams having angularly related boresight axes.

8. The antenna according to claim 1 in which each of said slots has a transversely ridged profile.

9. The antenna according to claim 8 in which the profile of each of said slots is dumbbell-shaped.

10. The antenna according to claim 1 in which said waveguide is rectangular in cross-section and has a third wall, said second and third waveguide walls being perpendicular to said first wall and on opposite sides of said E plane, said slots being formed in said second and third walls whereby said energy radiation pattern is bi-directional with beam maximums boresighted transversely of and outwardly from said second and third walls.

11. The antenna according to claim 1 in which said ridged waveguide is rectangularly shaped and said second wall is opposite said first wall and also has a ridge projecting inwardly therefrom.

12. The antenna according to claim 11 in which said first wall is planar and said second wall is semicylindrical.

13. The antenna according to claim 12 in which said ridge is semicylindrical and disposed coaxially of said second wall.

14. The antenna according to claim 12 in which said ridge has a trapezoidally shaped cross section and projects inwardly from said second wall.

* * * * *